US007765714B2

(12) United States Patent
Ronning

(10) Patent No.: US 7,765,714 B2
(45) Date of Patent: Aug. 3, 2010

(54) MOIST ORGANIC PRODUCT DRYING SYSTEM HAVING A ROTARY WASTE HEAT EVAPORATOR

(75) Inventor: Richard L. Ronning, Leawood, KS (US)

(73) Assignee: Aeroglide Corporation, Cary, NC (US)

( * ) Notice: Subject to any disclaimer, the term of this patent is extended or adjusted under 35 U.S.C. 154(b) by 322 days.

(21) Appl. No.: 12/051,560

(22) Filed: Mar. 19, 2008

(65) Prior Publication Data

US 2008/0229610 A1 Sep. 25, 2008

Related U.S. Application Data

(60) Provisional application No. 60/896,131, filed on Mar. 21, 2007.

(51) Int. Cl.
*F26B 3/02* (2006.01)

(52) U.S. Cl. ..... 34/467; 34/477; 34/487; 34/72; 34/86; 34/219

(58) Field of Classification Search ..... 34/467, 34/471, 476, 477, 478, 487, 72, 84, 86, 218, 34/219

See application file for complete search history.

(56) References Cited

U.S. PATENT DOCUMENTS 4,346,523 A 8/1982 Ronning
5,157,849 A 10/1992 Ronning
5,983,521 A * 11/1999 Thompson ..... 34/467
6,584,699 B2 7/2003 Ronning et al.
7,654,011 B2 * 2/2010 Ronning et al. ..... 34/467

OTHER PUBLICATIONS

Waste Heat Evaporator: Conservation Opportunity; Richard L. Ronning; *Feedstuffs*: 28, (Feb. 9, 1981).

* cited by examiner

*Primary Examiner*—Jiping Lu
(74) *Attorney, Agent, or Firm*—Hovey Williams LLP

(57) ABSTRACT

A method and apparatus are provided for reducing the VOC and CO content of dryer offgas that is discharged into the atmosphere from a moist organic product drying process using thermal oxidizing apparatus that includes a furnace, mixing chamber, thermal oxidizer, tempering chamber, and an indirect gas-to-gas heat exchanger. The dryer offgas is separated into two portions, with a larger portion being preheated by indirect heat exchange with the hot gaseous output from the thermal oxidizer. The non-preheated portion is directed to a rotary waste heat evaporator in which moisture is removed therefrom. The preheated portion is recycled to the hot gas inlet of the dryer and serves the function of dryer heat transfer media. By removing moisture from the non-preheated portion of the offgas that is directed to the thermal oxidizing apparatus, simultaneous achievement of thermal oxidizer temperatures of 1600° F. or greater, and an adequate oxygen concentration of 5% by volume is achieved for optimized thermal oxidation of carbon monoxide and volatile organic compounds.

21 Claims, 5 Drawing Sheets

NATURAL GAS FUEL
13
80
22
28
74
76
78
FURNACE
MIXING CHAMBER
THERMAL OXIDIZER
15
82
14
COMBUSTION AIR 200°F
72
12
16 1853.6°F
84
46
48
TEMPERING CHAMBER
70
2
155.0°F
1 PRODUCT INPUT 192.0°F
30
38
ROTARY PREDRYER
WASTE HEAT EVAPORATOR
11
WATER 201.5°F
68
85
44
10 DRYER GAS OUT 235.7°F
296.0°F EXHAUST
AIR HEATER
20
17 985.0°F
90
88
43
64
18 341.0°F
86
-Hot Gas Side-
HEAT EXCHANGER
-Cool Gas Side-
19
45
66
9
235.7°F
62
52
8 DRYER GAS OUT 235.7°F
4 DRYER GAS IN 740.0°F
40
5
6
60
58
26
50
54
THREE-STAGE DRYER
56
7
PRODUCT OUT 210.0°F
3 DRYER FEED 192.0°F

MOIST ORGANIC PRODUCT DRYING SYSTEM HAVING A ROTARY WASTE HEAT EVAPORATOR

CROSS-REFERENCE TO RELATED APPLICATION

The present non-provisional application claims the benefit of U.S. Provisional Patent Application No. 60/896,131, entitled TWO-STAGE THERMAL OXIDATION OF DRYER OFFGAS, filed Mar. 21, 2007, which is specifically incorporated herein by reference thereto.

BACKGROUND OF THE INVENTION

1. Field of the Invention

This invention relates to a method and equipment for reducing contaminants such as volatile organic compounds (VOC's) and carbon monoxide (CO) normally present in dryer offgas that is discharged into the atmosphere from a moist organic product drying process. The equipment includes a product pre-dryer/waste heat evaporator, a primary product dryer, thermal oxidizing apparatus, a furnace, which serves to deliver hot products of combustion to the thermal oxidizing apparatus, and a gas-to-gas heat exchanger of the indirect type having a hot gas side and a cool gas side, hereinafter referred to as the primary heat exchanger, for bringing the hot gaseous output from the thermal oxidizing apparatus that is ultimately discharged into the atmosphere into indirect heat exchange relationship with recycle dryer offgas to increase the temperature of the recycle dryer offgas prior to its reentry into the dryer.

Efficient thermal oxidation of VOC's and CO requires correlation of four factors occurring simultaneously:

1) Adequate temperature;
2) Adequate oxygen concentration;
3) Adequate residence time; and
4) Adequate turbulence.

In the present process, a rotary waste heat evaporator is utilized to remove moisture from a portion of the dryer offgas thereby allowing the thermal oxidizing apparatus to achieve a much higher temperature while maintaining an adequate oxygen concentration than compared to conventional processes. The amount of moisture removed from the dryer off gas by the rotary waste heat evaporator and the input of fuel to the furnace are controlled and adjusted to provide a hot gaseous output from the thermal oxidizing apparatus that is at a temperature of at least about 1600° F. with an optimum 5% oxygen content by volume, which are sufficiently high to substantially oxidize VOC's and CO in dryer offgas that is discharged into the atmosphere.

2. Description of the Prior Art

Dryers have been used for many years to lower the moisture content of a variety of organic products, such as grain, including distiller's grain and the like, which nominally may have a water content as high as 60-75%. The recent emergence of ethanol plants producing substantial quantities of moist distiller's grain as output residue requiring drying for further commercial use, has rekindled interest in more efficient drying processes while, at the same time, necessitating that dryer offgas discharged into the atmosphere contain reduced amounts of VOC's and CO.

Commercial drying equipment has been previously designed and constructed to dry organic products to a predetermined acceptable level, which is normally about 10% moisture by weight, wet basis. It has been known for some time to incorporate thermal oxidizing apparatus in processes and equipment for drying moist organic products in order to lower the VOC and CO content of the product output from the dryer. In order to reduce the VOC and CO content of dryer offgas introduced into the atmosphere employing a thermal oxidizer, the hot gaseous output from the oxidizer should be at least about 1600° F. and the oxygen concentration should be at least about 5% by volume. Heretofore, the temperature of the output from the thermal oxidizer has been limited to temperatures in the order of 1400° F. when the oxygen concentration is increased to 5% by volume; hence, VOC and CO reduction has not been optimum.

Even though residence time of the offgas being oxidized was not restricted and gas turbulence not a significant factor, it was not heretofore feasible to adequately control both the temperature of the thermal oxidizer and its oxygen concentration, in order to significantly lower the VOC and CO content of the offgas introduced into the atmosphere. The temperature and the oxygen concentration could be controlled individually, but not simultaneously for most efficient operation of the thermal oxidizing apparatus.

SUMMARY OF THE INVENTION

In one embodiment of the present invention there is provided a process of reducing the VOC and CO emissions in dryer offgas that is discharged into the atmosphere from a moist organic product dryer. The process generally comprises separating the dryer offgas into first and second portions. The first portion is directed to a hot gas flow side of a rotary waste heat evaporator. In the rotary waste heat evaporator, moisture is removed from the first portion of the dryer offgas thereby forming a reduced moisture dryer offgas portion. Fuel and combustion air are combusted in a combination furnace and mixing chamber. The reduced moisture dryer offgas portion from the rotary waste heat evaporator is directed into the mixing chamber for mixing with the combustion products. The combined gaseous mixture is then introduced into a thermal oxidizer to form a hot gaseous output, the temperature of which is sufficient to decrease the VOC and CO content of the mixture entering the thermal oxidizer.

The second portion of dryer offgas is brought into indirect heat exchange relationship with the hot gaseous output from the thermal oxidizer within a primary heat exchanger to preheat the second portion of dryer offgas. The preheated second portion of dryer offgas then is recycled back to the dryer, and the hot gaseous output from the thermal oxidizer is discharged to the atmosphere after indirect heat exchange with the second portion of the dryer offgas.

In another embodiment of the present invention there is provided a process of drying moist organic material and reducing the VOC and CO emissions from dryer offgas generated in the process that is discharged into the atmosphere. The process generally comprises introducing a moist organic material and pre-dryer air into a product flow side of a rotary waste heat evaporator for removal of moisture from the moist organic material and producing a primary dryer product feed and pre-dryer discharge air. The pre-dryer discharge air is separated from the primary dryer product feed. The primary dryer product feed then is directed to a primary dryer where moisture is removed therefrom by contacting the primary dryer product feed with hot dryer gas thereby producing a dried organic product and dryer offgas.

The dryer offgas is separated into a first portion and a second portion, with the first portion of dryer offgas being directed into a hot gas flow side of the rotary waste heat evaporator. Moisture is removed from the first portion of the dryer offgas within the rotary waste heat evaporator thereby forming a reduced moisture dryer offgas portion. Fuel and combustion air are combusted in a combination furnace and mixing chamber. The reduced moisture dryer offgas portion is directed into the mixing chamber and mixed with the combustion products from the furnace. The mixture then is delivered to a thermal oxidizer which produces a hot gaseous output from the thermal oxidizer. The temperature of the hot gaseous output from the thermal oxidizer is raised to a sufficient level so as to decrease the VOC and CO content of the mixture input to the thermal oxidizer.

The second portion of dryer offgas is brought into indirect heat exchange relationship with the hot gaseous output from the thermal oxidizer within a primary heat exchanger to preheat the second portion of the dryer offgas thereby forming the hot dryer gas which is recycled back to the primary dryer. The hot gaseous output from the thermal oxidizer then is discharged to the atmosphere after indirect heat exchange with the second portion of the dryer offgas.

In yet another embodiment of the present invention, there is provided equipment for reducing the VOC and CO content of dryer offgas that is discharged into the atmosphere from a moist organic product drying process. The equipment generally comprises a rotary waste heat evaporator including a product flow side and a hot gas flow side. The product flow side presents a moist product and pre-dryer air inlet and a pre-dried product and air outlet. The hot gas flow side presents a hot gas inlet and a cool gas outlet. A first separator is operably connected with the pre-dried product and air outlet for separating the pre-dryer air and pre-dried product exiting the product flow side of the rotary waste heat evaporator. The first separator includes a discharge air outlet and a pre-dried product outlet. A primary dryer is also provided presenting a product inlet, a dryer air inlet, and a dryer outlet through which the dried organic product and dryer offgas exit. A conveyor leads from the first separator pre-dried product outlet to the primary dryer inlet for delivering pre-dried product from the first separator to the primary drier. A second separator is provided for separating the dried organic product from the dryer offgas, the second separator presenting a dryer offgas outlet and a dried product outlet. A duct leads from the dryer offgas outlet to the hot gas inlet of the rotary waste heat evaporator for delivery of the dryer offgas from the primary dryer to the rotary waste heat evaporator. The dryer offgas serves as the primary heat source to the rotary waste heat evaporator.

The equipment further comprises thermal oxidizing apparatus including a thermal oxidizer having an input and an output, a combination furnace, and mixing chamber operably connected to the input of the thermal oxidizer, and a tempering chamber that communicates with the thermal oxidizer. A duct connects the rotary waste heat evaporator cool gas outlet with the combination furnace and mixing chamber for delivering cooled gas from the rotary waste heat evaporator to the combination furnace and mixing chamber. The cooled gas is mixed with the combustion products of the combination furnace and mixing chamber within the combination furnace and mixing chamber.

An indirect primary heat exchanger is provided presenting a cool gas side and a hot gas side. The cool gas side includes a cool gas inlet and a hot gas outlet, and the hot gas side presents a hot gas inlet and a cooled gas outlet. A duct extends between the duct leading to the hot gas inlet of the rotary waste heat evaporator and the primary heat exchanger cool gas inlet for diverting a portion of the dryer off gas to the cool gas side of the primary heat exchanger. A duct leads from the primary heat exchanger hot gas outlet to the dryer air inlet of the primary dryer for the recycle of heated dryer off gas to the primary dryer. A duct leads from the tempering chamber to the hot gas inlet of the primary heat exchanger for supplying hot gas to the hot gas side of the primary heat exchanger. A duct leads from the cooled gas outlet of the primary heat exchanger to the atmosphere for discharging offgas having reduced VOC and CO content to the atmosphere.

DETAILED DESCRIPTION OF THE PREFERRED EMBODIMENT

Figure 1:
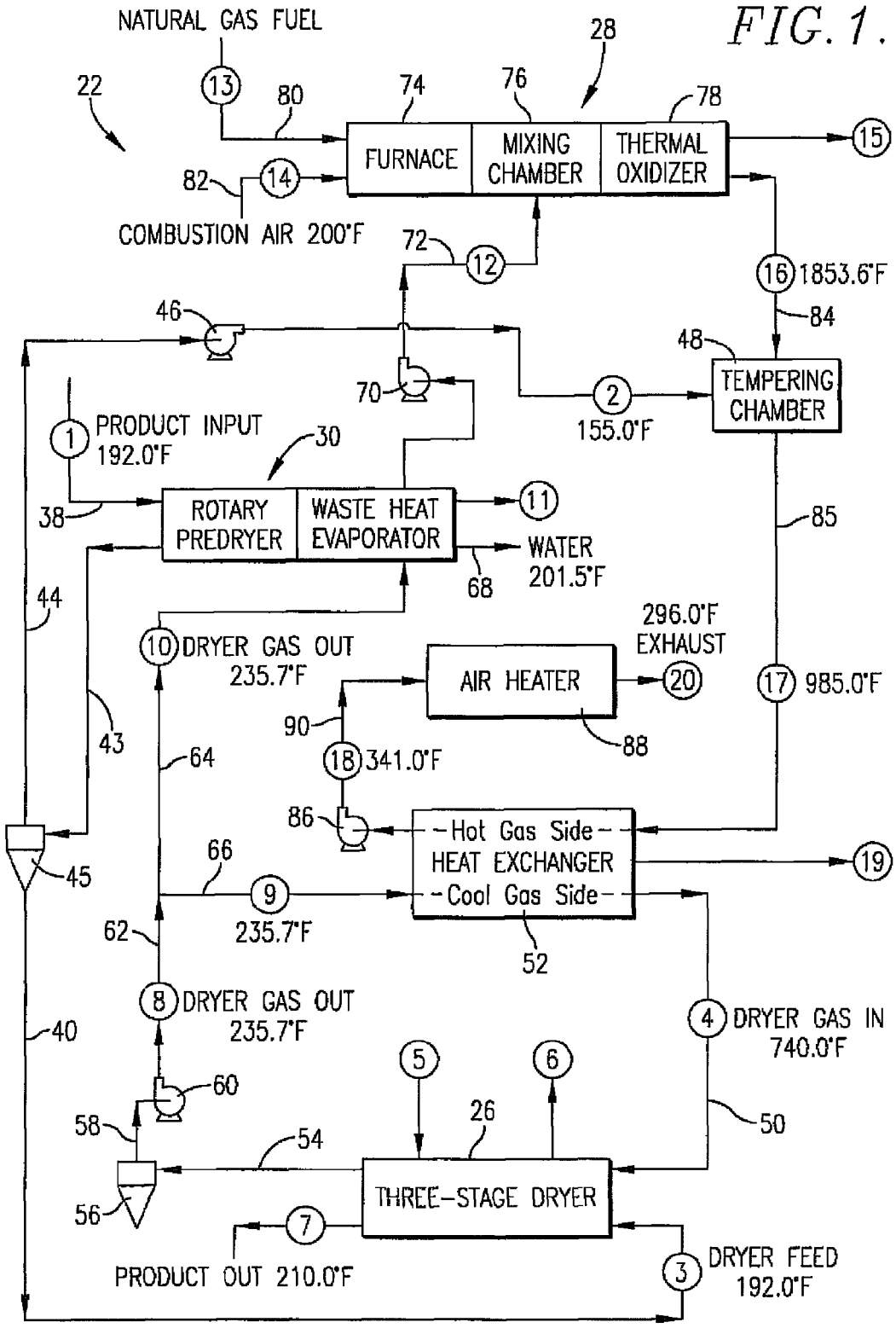
FIG. 1 is a flow diagram of a process for treating dryer offgas according to the present invention.
Figure 6:
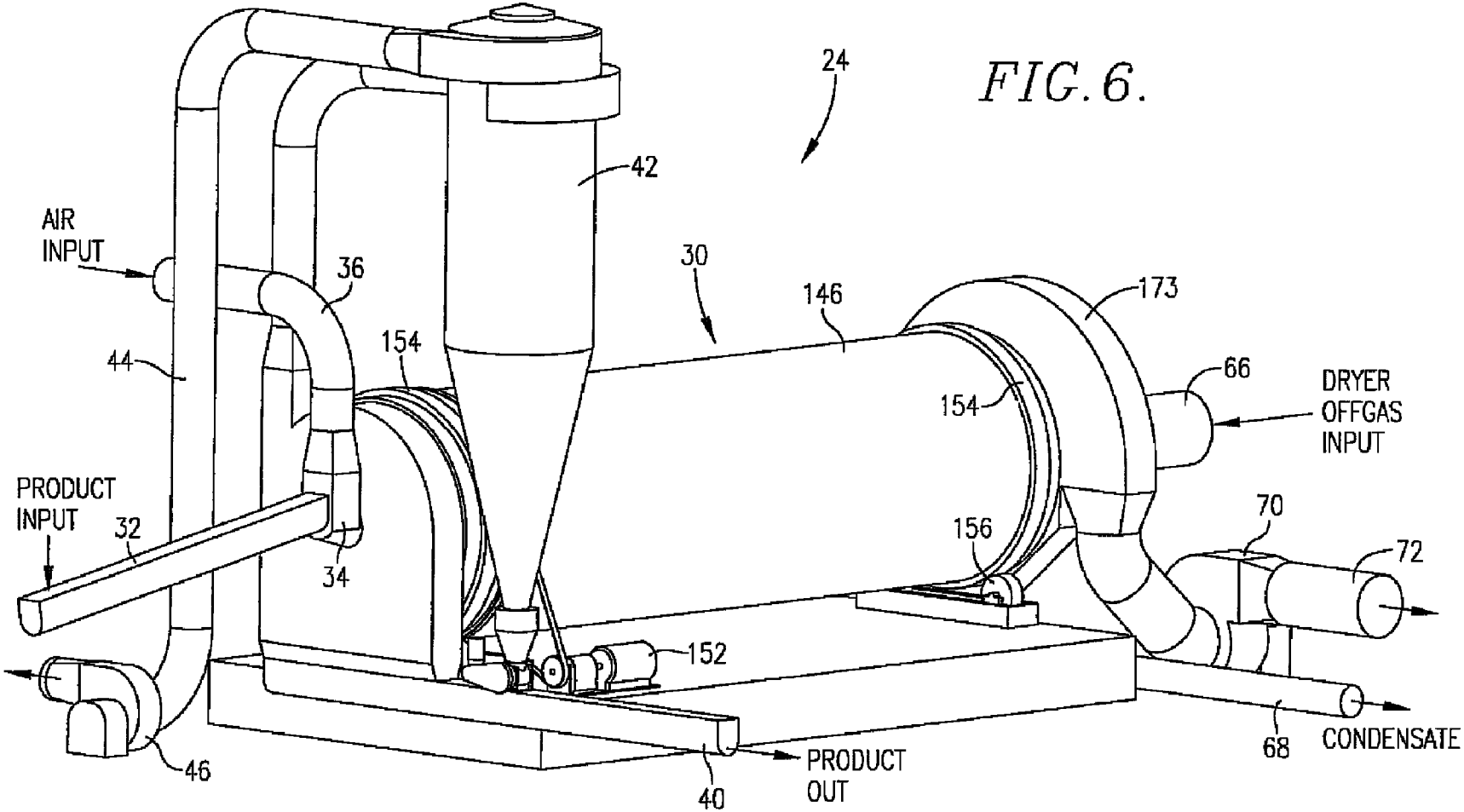
FIG. 6 is a perspective view of a rotary waste heat evaporator system that may be used with the present invention.

FIG. 1 illustrates an exemplary process 22 according to the present invention for reducing the VOC and CO content of dryer offgas that is discharged into the atmosphere from a moist organic product drying process. The process employs a predryer/waste heat recovery unit 24 (shown schematically in FIG. 6) in order to remove moisture from the moist product. Unit 24 also removes moisture from the dryer offgas so that higher thermal oxidizer temperatures may be achieved while maintaining a sufficient level of oxygen in the output from the thermal oxidizer. As explained hereunder, unit 24 is integrated with a primary product dryer 26 and thermal oxidizing apparatus 28 in order to achieve thermal oxidation of pollutants present in the dryer offgas prior to discharge to the atmosphere.

Moist product to be dried is initially fed to a rotary waste heat evaporator 30, also referred to herein as a predryer, by way of a product conveyor 32. Typically, the moist product supplied to process 22 is a high-moisture product having a water content as high as 60-75% by weight. In one embodiment of the present invention, the moist product comprises distiller's grain and the like, by-products from fermentation processes used in the production of ethanol. The moist product is generally supplied from the fermentation process as a wet cake and/or syrup. In other embodiments of the invention, the moist product to be dried may comprise animal or fish byproducts, municipal sludge, forage materials, or wood-byproducts.

In order to improve its handling and processing characteristics, the moist product may be combined with recycled dried product from dryer 26 prior to being supplied to predryer 30. In such embodiments, sufficient quantities of dried product are recycled so that the moist product fed to predryer 30 presents a moisture content of between about 22 to about 45% by weight, and particularly between about 25 to about 35% by weight. In certain embodiments, from about 75 to about 92% by weight of the total dried product discharged from dryer 26 is recycled and mixed with the wet cake and/or syrup before being fed to predryer 30.

Preheated air is also supplied to the product inlet 34 of predryer 30 via duct 36. As explained below, the air delivered via duct 36 may be preheated using energy recovered from the dryer offgas prior to discharge to the atmosphere. In certain embodiments, the predryer air input presents a temperature of between about 50 to about 250° F., and particularly, between about 100 to about 200° F. At product inlet 34, the moist product supplied by conveyor 32 is combined with the air delivered via duct 36. This combined moist product/air input is represented in FIG. 1 as process stream 38. In one embodiment of the present invention, predryer 30 comprises a unique four-pass predryer, although, it is within the scope of the present invention for predryer 30 to comprise one, two, three, or more passes for the product and dryer offgas. The particulars of this unique predryer/rotary waste heat evaporator are discussed in further detail below.

The pre-dried product is discharged from predryer 30 via a conveyor 40. The predryer air discharged from predryer 30 is first separated from entrained pre-dried product by a cyclone 42 (or other type of separator known to those of skill in the art). In FIG. 1, the output of air and product from predryer 30 is schematically represented by stream 43 and the separation of pre-dried product and air is schematically illustrated by separator 45. The discharged air, which may contain significant amounts of moisture, is removed from unit 24 via duct 44 with fan 46 supplying the motive force. In certain embodiments of the present invention, the air discharged from the product side of predryer 30 may be delivered to a yet-to-be-described tempering chamber 48 where it will be used to decrease the temperature of gas exiting thermal oxidizing apparatus 28.

The pre-dried product is then directed toward primary dryer 26 where final drying of the product occurs. In certain embodiments of the present invention, dryer 26 is a cylindrical, single-pass, co-current, three-stage, rotary drum, as illustrated, which is rotated about its longitudinal axis. Alternatively, the dryer may be of the rotary multiple-pass type. Further, the dryer may be of the non-rotating tubular type, or any type that incorporates direct-contact heat exchange between the product to be dried and a hot gaseous heat transfer media.

Heated gas enters dryer 26 through a duct 50 joined to the outlet of the cool gas side of an elongated, transversely rectangular, indirect, gas-to-gas heat exchanger herein referred to as the primary heat exchanger 52. The heated gas entering dryer 26 generally presents a temperature of between about 300 to about 800° F., or between about 600 to about 700° F., to effect final drying of the product. The heated gas is commingled with the moist product in the rotary dryer 26 in a direct-contact heat exchange process. During this heat exchange process, the moist product receives heat and rejects moisture in the form of steam, and the heated dryer offgas rejects heat, is cooled, and integrates the moisture rejected by the product into its composition. Upon exiting dryer 26, the dried product and off gas emitted from dryer 26 are delivered into a dropout chamber (not shown) which separates a large fraction of the dried product from the gaseous content of the dryer output. The offgas emitted from the dropout chamber along with the remaining fraction of entrained dried product moves into a separator, such as a centrifugal separator or cyclone 56 via duct 54, which separates another fraction of the dried product from the gaseous content. A portion of the dried products captured in the dropout chamber and centrifugal separator are recycled and combined with quantities of moist product to be dried that are fed to predryer 30 via product input 38. The portion of dried product that is not recycled may be conveyed to a cooling drum (not shown) and then discharged from process 22. Relatively particle-free offgas exits from cyclone 56 through a duct 58 which leads to the inlet of an induced draft fan 60. In certain embodiments, the dryer offgas presents a temperature of between about 200 to about 260° F.

The gas is discharged from fan 60 via duct 62 where it is separated into two portions. The first portion of dryer offgas is delivered to the gas flow side of rotary waste heat evaporator 30 via duct 64. The second portion of dryer offgas is carried through duct 66 toward the cool gas side inlet of primary heat exchanger 52. In certain embodiments of the present invention, the second portion of dryer offgas that is delivered to primary heat exchanger 52 comprises the majority of the dryer offgas carried by duct 62. Particularly, between about 60 to about 80% by weight of the total dryer offgas is contained within the second offgas portion carried by duct 66.

The first portion of dryer offgas that is delivered to the gas flow side of rotary waste heat evaporator 30 is nearly saturated with water. As the dryer offgas passes through rotary waste heat evaporator 30, a significant portion of the water is condensed and removed from the dryer offgas. As explained below, the removal of water from the dryer offgas contributes to the ability of the present invention to achieve sufficiently high temperatures within the thermal oxidizer, while also achieving sufficiently high oxygen levels to effect thermal oxidation of the VOCs and CO contained within the dryer offgas. In certain embodiments according to the present invention, at least about 25% by weight of the moisture, or between about 30 to about 60% by weight of the moisture, carried by the first portion of dryer offgas is condensed within rotary waste heat evaporator 30. The condensate is removed from rotary waste heat evaporator 30 via a conduit 68 and the reduced-moisture dryer offgas is removed by flue gas recycle (FOR) fan 70 and directed toward thermal oxidizing apparatus 28 via duct 72.

Thermal oxidizing apparatus 28 generally comprises a furnace 74, a mixing chamber 76, and a thermal oxidizer 78. (Note that in certain embodiments, furnace 74 and mixing chamber 76 may present as a combined furnace and mixing chamber as the apparatus is fluidly coupled together.) A fuel supplied by conduit 80 is combusted within furnace 74 with combustion air supplied by duct 82. In certain embodiments, natural gas is utilized as the fuel that is combusted within furnace 74. However, it is also within the scope of the present invention for fuels other than natural gas to be used including propane, light and heavy fuel oils, and solid fuels. In yet additional embodiments, the combustion air supplied via duct 82 is preheated as opposed to being supplied at or near ambient temperature. Particularly, the combustion air is preheated to a temperature of between about 100 to about 250° F.

The hot products of combustion from furnace 74 enter mixing chamber 76 where they are combined with the dryer offgas from duct 72. The mixture is then directed to thermal oxidizer 78. If desired, a second thermal oxidizer may be provided in series flow relationship with the thermal oxidizer 78 to provide additional residence time of the thermal oxidizer process. The removal of moisture from the dryer offgas in rotary waste heat evaporator 30 means that less water is being heated within thermal oxidizing apparatus 28. Consequently, higher thermal oxidation temperatures may be achieved within apparatus 28 while also maintaining sufficient oxygen levels thereby ensuring the thermal oxidation of the VOC and CO pollutants contained within the dryer offgas. The quantity of natural gas, the quantity and temperature of the combustion air introduced into furnace 74, and the quantity, temperature and moisture content of the dryer offgas introduced into mixing chamber 76 are all controlled such that the hot gaseous output from the thermal oxidizer 78 leading to tempering chamber 48 is at a temperature of at least about 1600° F. and has an oxygen concentration of at least about 5% by volume. In certain embodiments, the temperature of the output from the thermal oxidizer 78 is at least about 1700° F., and in still other embodiments the temperature of the output from the thermal oxidizer is at least about 1800° F., all while the oxygen concentration is at least about 5% by volume.

In certain embodiments of the invention, heat exchanger 52 is constructed with conventional materials in order to reduce capital expenses. Thus, it is important that the temperature of the hot gaseous output from the thermal oxidizer 78 be reduced so as to avoid damaging heat exchanger 52. Otherwise, heat exchanger 52 would need to be constructed from more expensive materials capable of withstanding the extreme temperatures of the hot gaseous output from the thermal oxidizer. The hot gaseous output from the thermal oxidizer 78 is directed to tempering chamber 48 via duct 84. Within tempering chamber 48, the temperature of the hot gaseous output from the thermal oxidizer 78 is reduced to less than about 1600° F. before being directed into the hot gas side of the primary heat exchanger 52. In other embodiments of the present invention, the hot gaseous output from the thermal oxidizer is reduced to a temperature of between about 900 to about 1400° F. This temperature reduction is accomplished at least in part by combining the hot gaseous output from the thermal oxidizer with at least a portion of the air discharged from predryer 30 conducted to tempering chamber 48 by duct 44. The two gaseous products are well-mixed within tempering chamber 48 and then delivered to the hot gas side of the primary heat exchanger 52 via duct 85.

Within primary heat exchanger 52, heat is indirectly transferred from this hot gaseous mixture to the dryer offgas moving in a counterflow direction on the cool gas side of the primary heat exchanger. During this process the gaseous mixture on the hot gas side of the primary heat exchanger 52 is substantially cooled before exiting the hot gas side of the primary heat exchanger. In certain embodiments of the present invention, the gaseous mixture is cooled to a temperature of between about 300 to about 550° F. within primary heat exchanger 52. A fan 86 provides the motive force for moving the gaseous products and mixtures through thermal oxidizing apparatus 28, tempering chamber 48, and the hot gas side of primary heat exchanger 52.

In certain embodiments, the cooled gaseous mixture exiting the primary heat exchanger hot gas side is delivered to the hot gas side inlet of air heater 88 via duct 90. Air heater 88 may be used to preheat the combustion air supplied to furnace 74 via duct 82 and/or preheat the air input to predryer 30 via input 38. A stream of cooled gaseous mixture exits the hot gas side of the air heater 88 and exits to the atmosphere through a stack. Again, fan 86 provides the motive force for moving the gaseous mixture through air heater 88 and exhausting to the atmosphere.

The table below illustrates processing conditions and flow rates that may be encountered in an exemplary embodiment of the process of FIG. 1. The label in the first column of the table corresponds with the stream label in FIG. 1.

TABLE 1

| | |
|---|---|
| 1 | Product and Predryer Air Input to Rotary Waste Heat Evaporator<br>192.0° F. (product)<br>200.0° F. (air)<br>320,865.3 lb/hr (product)[1]<br>120,000.0 lb/hr (air)<br>36.55% - Moisture (product)<br>117,259.2 lb/hr - $H_2O$ |
| 2 | Predryer Air Output to Tempering Chamber<br>155.0° F.<br>150,000.0 lb/hr - Total<br>30,000.0 lb/hr - $H_2O$ |
| 3 | Dryer Feed<br>192.0° F.<br>290,865.3 lb/hr - Total<br>30.0% - Moisture<br>203,605.71 lb/hr - Solids<br>87,259.59 lb/hr - $H_2O$ |
| 4 | Dryer Gas Input<br>740.0° F.<br>278,523 lb/hr - Total<br>28,080 lb/hr - $N_2$<br>8,483 lb/hr - $O_2$<br>18 lb/hr - $CO_2$<br>241,941 lb/hr - $H_2O$<br>222,550 acfm |
| 5 | Dryer Air Leaks<br>50° F.<br>−12.6° F. - Dewpoint<br>5.3% - Relative Humidity<br>9,000 lb/hr - Total<br>6,906 lb/hr - $N_2$<br>2,086 lb/hr - $O_2$<br>4 lb/hr - $CO_2$<br>4 lb/hr - $H_2O$<br>2,000 acfm |
| 6 | Dryer and Piping Radiation and Convection Losses<br>100,000 Btu/hr |
| 7 | Dryer Product Output<br>210° F.<br>231,370.13 lb/hr - Total<br>12.0% Moisture<br>203,605.71 lb/hr - Solids<br>27.764.42 lb/hr - $H_2O$ |
| 8 | Dryer Offgas<br>235.7° F.<br>347,018 lb/hr - Total<br>34,986 lb/hr - $N_2$<br>10,570 lb/hr - $O_2$<br>23 lb/hr - $CO_2$<br>301,440 lb/hr - $H_2O$<br>205.7° F. - Dewpoint<br>160,710 acfm |
| 9 | Dryer Offgas to Primary Heat Exchanger<br>235.7° F.<br>278,523 lb/hr - Total<br>28,080 lb/hr - $N_2$<br>8,483 lb/hr - $O_2$<br>18 lb/hr - $CO_2$<br>241,941 lb/hr - $H_2O$<br>205.7° F. - Dewpoint<br>128,989 acfm |
| 10 | Dryer Offgas to Rotary Waste Heat Evaporator<br>235.7° F.<br>68,495 lb/hr - Total<br>6,906 lb/hr - $N_2$<br>2,086 lb/hr - $O_2$<br>4 lb/hr - $CO_2$<br>59,499 lb/hr - $H_2O$<br>205.7° F. - Dewpoint<br>31,721 acfm<br>6.61 lb $H_2O$/lb dry gas |
| 11 | Condensate from Rotary Waste Heat Evaporator<br>201.5° F.<br>30,000 lb/hr - $H_2O$<br>30,309,746 btu/hr |
| 12 | Dryer Offgas Output from Rotary Waste Heat Evaporator<br>201.5° F.<br>100.0% Relative Humidity<br>38,495 lb/hr - Total<br>6,906 lb/hr - $N_2$ |

TABLE 1-continued

| | |
|---|---|
| | 2,086 lb/hr - $O_2$ |
| | 4 lb/hr - $CO_2$ |
| | 29,499 lb/hr - $H_2O$ |
| | 16,263 acfm |
| 13 | Natural Gas Fuel |
| | 3,549.5457 lb/hr |
| | 77,685,356 Btu/hr (HHV) |
| | 1,306 Btu/lb Water Evaporated |
| 14 | Combustion Air |
| | 50° F., preheated to 200° F. |
| | 45.00% - Excess Air |
| | 81,189 lb/hr - Total |
| | 62,295 lb/hr - $N_2$ |
| | 18,820 lb/hr - $O_2$ |
| | 41 lb/hr - $CO_2$ |
| | 34 lb/hr - $H_2O$ |
| | 23,350 acfm |
| 15 | Furnace/Mixing Chamber/Thermal Oxidizer |
| | Radiation and Convection Losses |
| | 200,000 Btu/hr |
| 16 | Gaseous Output from Thermal Oxidizer |
| | 1853.6° F. |
| | 123,234 lb/hr - Total |
| | 69,477 lb/hr - $N_2$ |
| | 7,927 lb/hr - $O_2$ |
| | 9,074 lb/hr - $CO_2$ |
| | 36,755 lb/hr - $H_2O$ |
| | 0 lb/hr - $SO_2$ |
| | 144,917 acfm |
| | 4.9927% v/v $O_2$ |
| 17 | Output from Tempering Chamber |
| | 985.0° F. |
| | 273,234 lb/hr - Total |
| | 66755 lb/hr - $H_2O$ |
| 18 | Output from Primary Heat Exchanger |
| | 341.0° F. |
| | 273,234 lb/hr - Total |
| 19 | Heat Exchanger Radiation and Convection Losses |
| | 200,000 Btu/hr |
| 20 | Atmospheric Exhaust |
| | 296° F. |
| | 273,234 lb/hr - Total |

[1]Includes 145,446 lb/hr wet cake, 66.04% moisture and 175,136.3 lb/hr recycle from dryer, 12.0% moisture.

Figure 2:
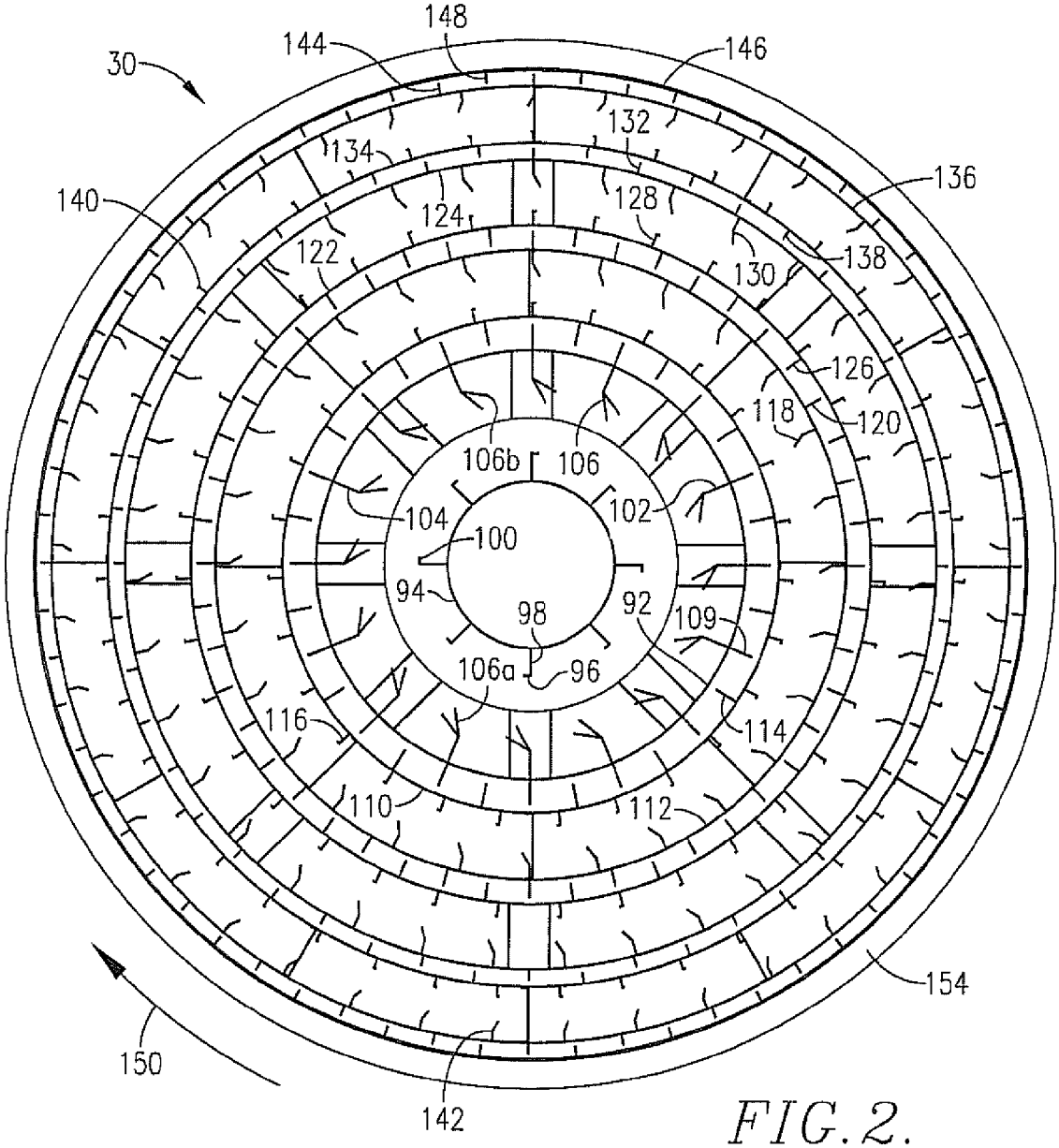
FIG. 2 is a cross-sectional view of an exemplary four-pass rotary waste heat evaporator for use with the present invention.

As noted above, certain embodiments of the present invention employ a unique four-pass rotary waste heat evaporator 30. As shown in FIG. 2, rotary waste heat evaporator 30 comprises a plurality of concentric tube sections, with each tube section defining either a product flow pass or an air flow pass. The innermost tube section comprises a generally cylindrical outer wall 92 and a generally cylindrical inner wall 94. The outer surface of inner wall 94 is provided with a plurality of longitudinally extending flights 96. Flights 96 comprise a radially projecting portion 98 and a transversely extending outer toe portion 100. The inner surface of outer wall 92 also presents a plurality of longitudinally extending product flow flights 102. Each flight also comprises an inwardly extending portion 104 and an obliquely extending distal segment 106. It is noted that distal segment 106 presents a varied geometry between the central portion of the flight and the outer ends of the flight. The central portion of the flight presents a distal segment 106*a* that extends away from the inwardly extending portion 104 at an angle of approximately 30°. The outer ends of the flight present distal segments 106*b* that extend away from the inwardly extending portion 104 at a greater angle, approximately 60°. This altered geometry is required because of the presence of frustoconical section 108 formed by inner wall 94 (see, FIG. 4). Thus, the more angled distal segments 106*b* extend along the inner surface of outer wall 92 at least in the region of frustoconical section 108. In certain embodiments of the present invention, the distal segments 106*b* extend along approximately the outer 24 inches of the flight. The outer surface of outer wall 92 presents a plurality of radially projecting gas flow flights 109. The gas flow flights of rotary waste heat evaporator 30 present a unique configuration that is discussed in greater detail below.

A second tube section is disposed about the outside of the innermost tube section and comprises an inner wall 110 and an outer wall 112. The inwardly facing surface of inner wall 110 presents a plurality of longitudinally extending, inwardly projecting gas flow flights 114. The outer facing surface of inner wall 110 presents a plurality of radially projecting flights 116 which are very similar in configuration to flights 96. The inwardly facing surface of outer wall 112 presents a plurality inwardly projecting product flow flights 118 which are very similar in configuration to product flow flights 102, except that the geometry of the flights is substantially uniform and the distal segments extend away from the inwardly extending portions at an angle of approximately 30°. The outer surface of outer wall 112 presents a plurality of gas flow flights 120 that are very similar in configuration to flights 114.

A third tube section is disposed around the outside of the second tube section and comprises an inner wall 122 and an outer wall 124. The inwardly facing surface of inner wall 122 presents a plurality of inwardly projecting gas flow flights 126 that are similar in configuration to gas flow flights 114 and 120. The outer surface of inner wall 122 presents a plurality of flights 128 that are similar in configuration to flights 96 and 116. The inwardly facing surface of outer wall 124 presents a plurality of inwardly projecting product flow flights 130 that are similar in configuration to flights 118. The outer surface of outer wall 124 presents a plurality of radially projecting gas flow flights 132 similar in configuration to gas flow flights 120.

A fourth tube section is disposed around the outside of the third tube section and comprises an inner wall 134 and an outer wall 136. The inwardly facing surface of inner wall 134 presents a plurality of inwardly projecting gas flow flights 138 that are similar in configuration to gas flow flights 126. The outer surface of inner wall 134 presents a plurality of flights 140 that are similar in configuration to flights 128. The inwardly facing surface of outer wall 136 presents a plurality of inwardly projecting product flow flights 142 that are similar in configuration to flights 130. The outer surface of outer wall 136 presents a plurality of radially extending gas flow flights 144 similar in configuration to gas flow flights 132.

Surrounding the fourth tube section is an outer drum 146. The inwardly facing surface of drum 146 presents a plurality of inwardly projecting gas flow flights 148 that are similar in configuration to gas flow flights 138.

In operation, rotary waste heat evaporator 30 is rotated in the direction indicated by arrow 150 (clockwise in FIG. 2 which is looking toward the hot gas inlet) by a motor 152. Rotary waste heat evaporator 30 is provided with track or tire sections 154 which contact trunnion wheels 156 during rotation thereof.

Figure 5:
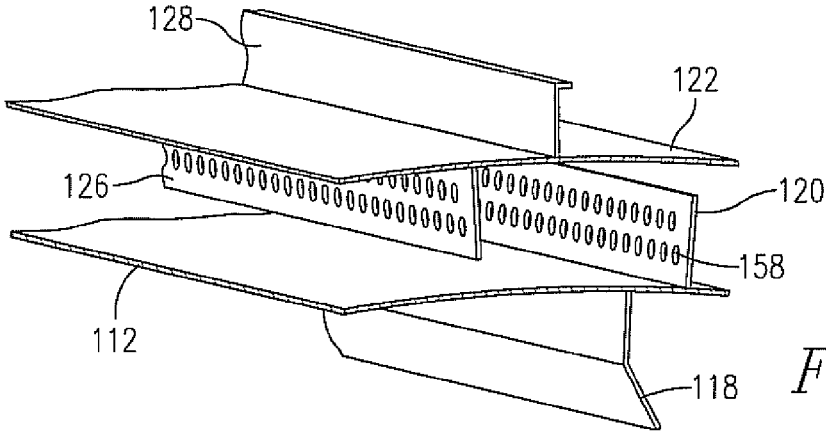
FIG. 5 is a fragmentary view of a section of the four-pass rotary waste heat evaporator illustrating the perforated flights located in a gas flow passage of the evaporator.

Turning now to FIG. 5, the unique configuration of gas flow flights 109, 114, 120, 126, 132, 138, 144, and 148 will be explained. FIG. 5 is a fragmentary, perspective view of a portion of outer wall 112 of the second tube section and a portion of inner wall 122 of the third tube section. Gas flow flights 120 and 126 present as longitudinally extending, perforate plates normally projecting from the respective wall surface. In the embodiment illustrated, flights 120 and 126 comprise two rows of orifices 158. The precise dimensions of the gas flow flights, including the quantity and arrangement of orifices therein, is dependent upon the distance between adjacent wall surfaces. For example, gas flow flights 109 and 114 reside in the gas flow passage between outer wall 92 of the innermost tube section and inner wall 110 of the second tube section. As the radii of these inner tube sections is less than, for example, the radii of the outer two tube sections, the distance between walls 92 and 110 is greater than the distance between walls 124 and 134 in order to accommodate the volume of gas flowing through the rotary waste heat evaporator 30.

In the embodiment of the present invention illustrated in FIG. 2, three different gas flow flight configurations are employed. The largest gas flow flights (in dimension and number of orifices) are gas flow flights 109 and 114 positioned between walls 92 and 110. These gas flow flights generally present three rows of orifices. The next largest gas flow flights are flights 120 and 126 positioned between walls 112 and 122, which are shown in FIG. 5. The distance between walls 112 and 122 is less than the distance between walls 92 and 110. Flights 120 and 126 present two rows of orifices. The outer two gas flow regions, the space between walls 124 and 134 and the space between wall 136 and drum 146, comprises the smallest gas flow flights. Flights 132, 138, 144, and 148 present a single row of orifices.

In certain exemplary embodiments, the gas flow flights present widths of approximately 1.5, 2.5, and 3.5 inches, respectively. The orifices formed in the flights are approximately 0.5 inch in diameter and spaced approximately one inch apart. However, the flights need not necessarily present these dimensions or orifice arrangements. Thus, the sizing and configuration of the perforate gas flow flights may depend upon a number of factors such as the size of the rotary waste heat evaporator and the throughput for which it is designed.

The orifices present in the gas flow flights allow for more effective contact between the gas and condensate flowing within the gas flow regions. This enhanced contact leads to increased condensation of moisture from the dryer offgas and greater transfer of heat between the gas flow side and product flow side of the rotary waste heat evaporator 30.

Figure 3:
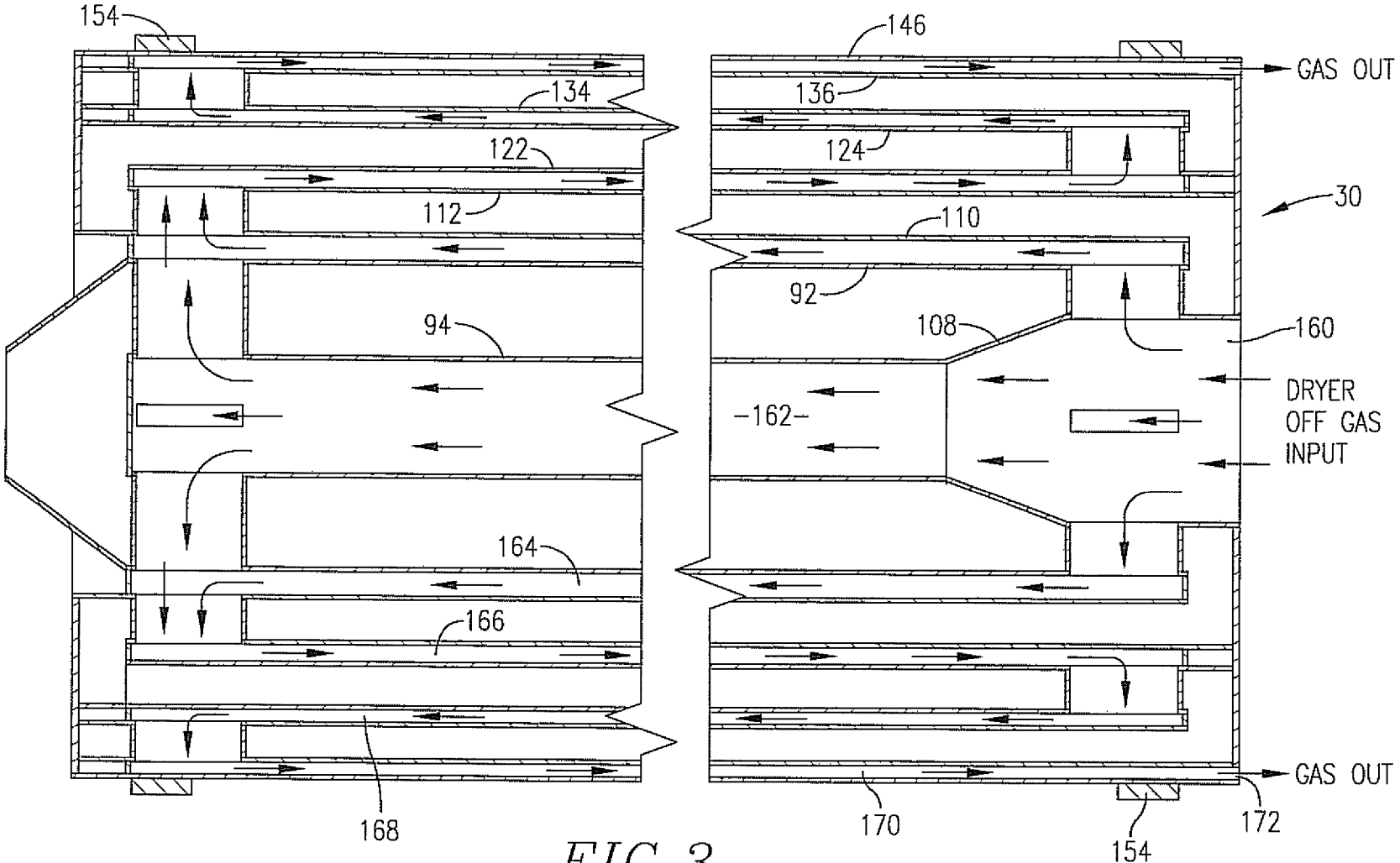
FIG. 3 is a fragmentary, longitudinal section of the four-pass rotary waste heat evaporator of FIG. 2 illustrating the dryer off gas flow path therethrough.
Figure 4:
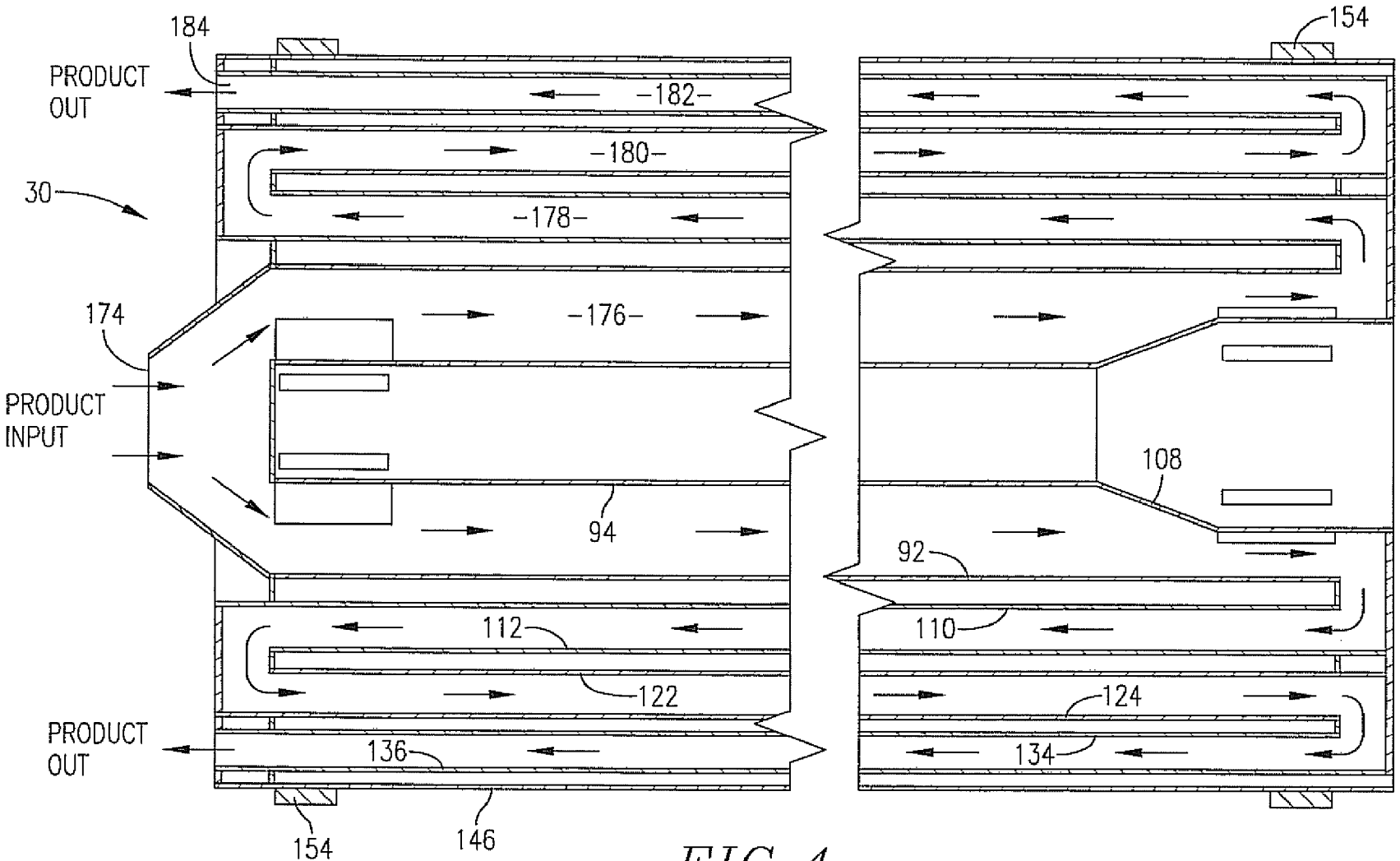
FIG. 4 is a fragmentary, longitudinal section of the four-pass rotary waste heat evaporator of FIG. 2 illustrating the product flow path therethrough.

Turning now to FIGS. 3 and 4, both the product and gas flow paths through rotary waste heat evaporator 30 are illustrated. All flighting has been removed from these figures for clarity purposes. The flow of dryer offgas through rotary waste heat evaporator 30 is shown in FIG. 3. Dryer offgas is delivered to a hot gas inlet 160 via duct 66. Within inlet 160, the first pass of dryer offgas is split into two portions. The first portion of dryer offgas continues through frustoconical section 108 into a central passage 162 defined by wall 94. The second portion of dryer offgas is diverted into gas flow passage 164 that is defined as the space between walls 92 and 110. Passages 162 and 164 combined represent the first pass of dryer offgas through rotary waste heat evaporator 30. Proximate the end of rotary waste heat evaporator 30 opposite the hot gas inlet 160, the two portions of dryer offgas from the first pass are recombined and directed outwardly into gas flow passage 166 that is defined as the space between walls 112 and 122. At this point, the dryer offgas flow will also contain water that has been condensed during the first pass. Thus, the flow of material through the gas flow side of rotary waste heat evaporator 30 is generally two phase, gaseous and liquid.

The dryer offgas (and any condensed water) flows through passage 166 in a countercurrent manner with respect to the offgas flowing through passages 162 and 164. Once the dryer offgas reaches the end of passage 166 proximate hot gas inlet 160, the offgas is directed outwardly into gas flow passage 168 that is defined as the space between walls 124 and 134. The dryer offgas flows through passage 168 in a co-current manner with respect to the flow through passages 162 and 164 and in a countercurrent manner with respect to the flow through passage 166.

Upon reaching the end of passage 166 that is opposite inlet 160, the dryer offgas (and condensed water) are directed outwardly into yet another gas flow passage 170 that is defined by wall 136 and drum 146. The dryer offgas flows through passage 170 in a co-current manner with respect to the flow through passage 166 and countercurrent with respect to the flow through passages 162, 164, and 168. The dryer offgas (and condensed water) exit passage 168 via a gas outlet 172. The condensate is collected by plenum 173 and is removed from rotary waste heat evaporator 30 by conduit 68 (see, FIG. 6). The cooled, reduced-moisture dryer offgas is removed from rotary waste heat evaporator 30 by means of fan 70 and directed to thermal oxidizing apparatus 28 via duct 72. Thus, the dryer offgas makes a total of four passes through rotary waste heat evaporator 30 from inlet 160 to outlet 172. Further, the input and discharge of dryer offgas occurs at the same end of the rotary waste heat evaporator 30.

FIG. 4 illustrates the flow path of moist product through rotary waste heat evaporator 30. Moist product and predryer air enter rotary waste heat evaporator 30 through a product inlet 174. Upon entering, the product is directed outwardly around the innermost tube section inner wall 94 into a first product flow passage 176 that is defined by walls 92 and 94. Product flows through passage 176 in a countercurrent manner with respect to the dryer offgas flow through central gas flow passage 162. Generally, throughout rotary waste heat evaporator 30, each consecutive pass of product is countercurrent to the respective pass of dryer offgas. Near the end of passage 176 opposite product inlet 174, passage 176 becomes constricted or narrowed because of frustoconical section 108.

The product is then directed outwardly into a second product flow passage 178 that is defined by walls 110 and 112. Product flows through passage 178 in a countercurrent manner with respect to the flow of product through passage 176. Upon nearing the end of passage 178 that is proximate product inlet 174, the product is directed outwardly into a third product passage 180. Product passage 180 is defined by walls 122 and 124. Product flows through passage 180 in a countercurrent manner with respect to the flow of product through passage 178 and in a co-current manner with respect to the flow of product through passage 176. Upon nearing the end of passage 180 that is opposite product inlet 174, the product is directed outwardly into a fourth product passage 182. Product passage 182 is defined by walls 134 and 136. Product flows through passage 182 in a co-current manner with respect to the flow of product through passage 178 and in a countercurrent manner with respect to the flow of product through passages 176 and 180. Product flows through passage 182 until it reaches product outlet 184 where it falls into conveyor 40 (see, FIG. 6) and is directed toward primary dryer 26.

It is to be understood that the foregoing description of various embodiments of the present invention is provided by way of illustration and nothing therein should be taken as a limitation upon the overall scope of the invention.

I claim:

1. A process of reducing the VOC and CO emissions in dryer offgas that is discharged into the atmosphere from a moist organic product dryer comprising the steps of:

a. separating said dryer offgas into a first portion and a second portion;

b. directing said first portion of the dryer offgas to a hot gas flow side of a rotary waste heat evaporator;

c. removing moisture from said first portion of the dryer offgas within said rotary waste heat evaporator thereby forming a reduced moisture dryer offgas portion;

d. combusting fuel and combustion air in a combination furnace and mixing chamber;

e. directing said reduced moisture dryer offgas portion into said mixing chamber for mixing with the combustion products of step d;

f. introducing the mixture from step e into a thermal oxidizer and forming a hot gaseous output from the thermal oxidizer, the temperature of the hot gaseous output from the thermal oxidizer being raised to a sufficient level so as to decrease the VOC and CO content of the mixture from step e;

g. bringing said second portion of said dryer offgas into indirect heat exchange relationship with said hot gaseous output from said thermal oxidizer within a primary heat exchanger to preheat said second portion of the dryer offgas;

h. recycling said preheated second portion of dryer offgas back to said dryer; and i. discharging the hot gaseous output from the thermal oxidizer to the atmosphere after indirect heat exchange with said second portion of the dryer offgas of step g.

2. The process of claim 1, step c including the removal of a sufficient quantity of water from said first portion of dryer offgas so that the hot gaseous output from the thermal oxidizer of step f presents a temperature of at least about 1600° F.

3. The process of claim 2, wherein is included the step of maintaining the oxygen content of said hot gaseous output from the thermal oxidizer at a level of at least 5% by volume.

4. The process of claim 2, step c resulting in the removal of at least 25% by weight of the moisture from said first portion of dryer offgas entering the hot gas flow side of said rotary waste heat evaporator.

5. The process of claim 1, wherein step g includes preheating said second portion of dryer offgas to a temperature of from about 300 to about 800° F.

6. The process of claim 1, wherein is included the step of passing the hot gaseous output from the thermal oxidizer through a tempering chamber to reduce the temperature thereof before the hot gaseous output is brought into indirect heat exchange relationship with said second portion of dryer offgas.

7. The process of claim 6, wherein said rotary waste heat evaporator includes a product flow side into which a moist product to be dried and pre-dryer air is introduced and from which is output a pre-dryer discharge.

8. The process of claim 7, wherein said pre-dryer discharge is separated into a pre-dryer product output and a pre-dryer discharge air, said pre-dryer discharge air is directed to said tempering chamber where it is mixed with the hot gaseous output from the thermal oxidizer to reduce the temperature of the hot gaseous output.

9. A process of drying moist organic material and reducing the VOC and CO emissions from dryer offgas generated in said process that is discharged into the atmosphere, said process comprising the steps of:

a. introducing a moist organic material and pre-dryer air into a product flow side of a rotary waste heat evaporator for removal of moisture from said moist organic material and producing a primary dryer product feed and pre-dryer discharge air;

b. separating said pre-dryer discharge air from said primary dryer product feed;

c. directing said primary dryer product feed to a primary dryer;

d. removing moisture from said primary dryer product feed by contacting said primary dryer product feed with hot dryer gas thereby producing a dried organic product and dryer offgas;

e. separating said dryer offgas into a first portion and a second portion;

f. directing said first portion of dryer offgas into a hot gas flow side of said rotary waste heat evaporator;

g. removing moisture from said first portion of the dryer offgas within said rotary waste heat evaporator thereby forming a reduced moisture dryer offgas portion;

h. combusting fuel and combustion air in a combination furnace and mixing chamber;

i. directing said reduced moisture dryer offgas portion into said mixing chamber for mixing with the combustion products of step h;

j. introducing the mixture from step i into a thermal oxidizer and forming a hot gaseous output from the thermal oxidizer, the temperature of the hot gaseous output from the thermal oxidizer being raised to a sufficient level so as to decrease the VOC and CO content of the mixture from step i;

k. bringing said second portion of said dryer offgas into indirect heat exchange relationship with said hot gaseous output from said thermal oxidizer within a primary heat exchanger to preheat said second portion of the dryer offgas thereby forming said hot dryer gas which is recycled back to said primary dryer; and l. discharging the hot gaseous output from the thermal oxidizer to the atmosphere after indirect heat exchange with said second portion of the dryer offgas of step k.

10. The process of claim 9, step g including the removal of a sufficient quantity of water from said first portion of dryer offgas so that the hot gaseous output from the thermal oxidizer of step f presents a temperature of at least about 1600° F.

11. The process of claim 10, wherein is included the step of maintaining the oxygen content of said hot gaseous output from the thermal oxidizer at a level of at least 5% by volume.

12. The process of claim 10, step g resulting in the removal of at least 25% by weight of the moisture from said first portion of dryer offgas entering the hot gas flow side of said rotary waste heat evaporator.

13. The process of claim 9, wherein step k includes preheating said second portion of dryer offgas to a temperature of from about 300 to about 800° F.

14. The process of claim 9, wherein is included the step of passing the hot gaseous output from the thermal oxidizer through a tempering chamber to reduce the temperature thereof before the hot gaseous output is brought into indirect heat exchange relationship with said second portion of dryer offgas.

15. The process of claim 14, wherein said pre-dryer discharge air is directed to said tempering chamber where it is mixed with the hot gaseous output from the thermal oxidizer to reduce the temperature of the hot gaseous output.

16. The process of claim 9, wherein a portion of said dried organic product from step d is recycled and combined with said moist organic material that is introduced into the product flow side of said rotary waste heat evaporator in step a.

17. The process of claim 9, wherein said hot gaseous output from the thermal oxidizer, subsequent to being used to preheat said second portion of dryer offgas and prior to being discharged to the atmosphere, being used to preheat said pre-dryer air that is introduced into the product flow side of said rotary waste heat evaporator and/or to preheat said combustion air that is combusted with said fuel in the combination furnace and mixing chamber.

18. Equipment for reducing the VOC and CO content of dryer offgas that is discharged into the atmosphere from a moist organic product drying process, said equipment comprising:

a. a rotary waste heat evaporator including a product flow side and a hot gas flow side, said product flow side presenting a moist product and pre-dryer air inlet and a pre-dried product and air outlet, said hot gas flow side presenting a hot gas inlet and a cool gas outlet;

b. a first separator operably connected with said pre-dried product and air outlet for separating the pre-dryer air and pre-dried product exiting the product flow side of said rotary waste heat evaporator, said first separator including a discharge air outlet and a pre-dried product outlet;

c. a primary dryer presenting a product inlet, a dryer air inlet, and a dryer outlet through which the dried organic product and dryer offgas exit said primary dryer;

d. a conveyor leading from said first separator pre-dried product outlet to said primary dryer inlet for delivering pre-dried product from said first separator to said primary drier;

e. a second separator for separating the dried organic product from the dryer offgas, said second separator presenting a dryer offgas outlet and a dried product outlet;

f. a duct leading from said dryer offgas outlet to said hot gas inlet of said rotary waste heat evaporator for delivery of the dryer offgas from said primary dryer to said rotary waste heat evaporator, said dryer off gas serving as the primary heat source for said rotary waste heat evaporator;

g. thermal oxidizing apparatus including a thermal oxidizer having an input and an output, a combination furnace and mixing chamber operably connected to the input of the thermal oxidizer, and a tempering chamber that communicates with the thermal oxidizer;

h. a duct connecting said rotary waste heat evaporator cool gas outlet with said combination furnace and mixing chamber for delivering cooled gas from said rotary waste heat evaporator to said combination furnace and mixing chamber;

i. an indirect primary heat exchanger presenting a cool gas side and a hot gas side, said cool gas side including a cool gas inlet and a hot gas outlet, said hot gas side presenting a hot gas inlet and a cooled gas outlet;

j. a duct extending between duct f and said primary heat exchanger cool gas inlet for diverting a portion of the dryer off gas to the cool gas side of said primary heat exchanger;

k. a duct leading from said primary heat exchanger hot gas outlet to said dryer air inlet of said primary dryer for the recycle of heated dryer off gas to said primary dryer;

l. a duct leading from said tempering chamber to the hot gas inlet of said primary heat exchanger for supplying hot gas to the hot gas side of said primary heat exchanger; and m. a duct leading from the cooled gas outlet of said primary heat exchanger to the atmosphere for discharging offgas having reduced VOC and CO content to the atmosphere.

19. Equipment as set forth in claim 18, wherein a tempering chamber is interposed between the thermal oxidizer and the hot gas side inlet of the primary heat exchanger.

20. Equipment as set forth in claim 19, further including a duct leading from said first separator discharge air outlet to said tempering chamber for delivery of offgas from said rotary waste heat evaporator to said tempering chamber where it is mixed with hot gas from said thermal oxidizer.

21. Equipment as set forth in claim 18, farther including a secondary indirect heat exchanger interposed in duct m downstream of said primary heat exchanger, said secondary heat exchanger operable to preheat pre-dryer air to be introduced into said rotary waste heat evaporator and/or operable to preheat combustion air to be combusted in said combination furnace and mixing chamber.

* * * * *